US007971658B2

(12) United States Patent
Buckman, Sr.

(10) Patent No.: US 7,971,658 B2
(45) Date of Patent: Jul. 5, 2011

(54) CHEMICALLY ENHANCED STIMULATION OF OIL/GAS FORMATIONS

(76) Inventor: William G. Buckman, Sr., Bowling Green, KY (US)

( * ) Notice: Subject to any disclaimer, the term of this patent is extended or adjusted under 35 U.S.C. 154(b) by 147 days.

(21) Appl. No.: 12/259,806

(22) Filed: Oct. 28, 2008

(65) Prior Publication Data

US 2009/0107678 A1 Apr. 30, 2009

Related U.S. Application Data

(60) Provisional application No. 61/001,183, filed on Oct. 31, 2007.

(51) Int. Cl.
*E21B 7/18* (2006.01)

(52) U.S. Cl. ..... 175/67; 175/424

(58) Field of Classification Search ..... 175/65, 175/67, 424

See application file for complete search history.

(56) References Cited

U.S. PATENT DOCUMENTS

| | | | | |
|---|---|---|---|---|
| 2,258,001 | A | 10/1941 | Chamberlain | |
| 2,271,005 | A | 1/1942 | Grebe | |
| 3,746,088 | A * | 7/1973 | Haskin et al. | 166/59 |
| 4,431,069 | A | 2/1984 | Dickinson, III | |
| 5,173,007 | A * | 12/1992 | Krajieck | 405/59 |
| 5,246,273 | A | 9/1993 | Rosar | |
| 5,373,906 | A * | 12/1994 | Braddick | 175/67 |
| 5,771,984 | A | 6/1998 | Potter | |
| 6,152,356 | A | 11/2000 | Minden | |
| 6,263,984 | B1 | 7/2001 | Buckman, Sr. | |
| 6,347,675 | B1 | 2/2002 | Kolle | |
| 6,668,948 | B2 | 12/2003 | Buckman, Sr. | |
| 6,772,847 | B2 | 8/2004 | Rae | |
| 7,168,491 | B2 | 1/2007 | Malone | |
| 2003/0164252 | A1 * | 9/2003 | Rae et al. | 175/67 |
| 2006/0260818 | A1 * | 11/2006 | Meijer et al. | 166/380 |

* cited by examiner

*Primary Examiner* — Giovanna C Wright
*Assistant Examiner* — Catherine Loikith
(74) *Attorney, Agent, or Firm* — Claude E. Cooke, Jr.; John J. Love; Cooke Law Firm

(57) ABSTRACT

Method is provided for drilling of formations containing carbonate minerals with flexible tubing capable of being turned in a very short radius. The very flexible tubing may be placed inside a work string in a well with coiled tubing and a micro-jet bit on the tubing be diverted to a selected direction and depth. Acidic drilling fluid pumped through the micro-jet bit allows high rates of drilling with hydrochloric acid. A slip joint between coiled tubing and the flexible tubing may be used to allow jet drilling without movement of the coiled tubing and use of a jet bit with forward-facing jets. Mixing of acid and base solutions downhole may be used to provide hotter acid solutions for drilling.

7 Claims, 5 Drawing Sheets

CHEMICALLY ENHANCED STIMULATION OF OIL/GAS FORMATIONS

This application claims the benefit of U.S. Provisional Application No. 61/001,183, filed on Oct. 31, 2007.

BACKGROUND OF INVENTION

1. Field of the Invention

This invention relates to drilling drain holes in the earth. More particularly, method and apparatus are provided for drilling through formations containing carbonate minerals using an acidic drilling fluid, a very flexible tubular and a micro-jet bit.

2. Description of Related Art

It is estimated that sixty to seventy percent of the oil and gas reserves in the world are in reservoirs having a predominance of carbonate minerals (limestone or dolomite). It is also estimated that over sixty percent of the original oil-in-place remains after traditional methods of oil production are exhausted. A large part of this oil is left in reservoirs because it is in rock that is not in adequate hydraulic communication with a well.

The typical procedure to produce oil or gas from a carbonate mineral formation is to drill a vertical well, place casing in the well, place cement between the casing and the formation, and perforate the casing. It is common to pump acid (usually 15% hydrochloric acid) through the perforations to improve fluid communication between the well and the formation. The acid may be pumped at low (matrix) rates to dissolve the rock around perforations, affecting only the region at or very near the wellbore, or it may be pumped at high rates and at a pressure above fracturing pressure to create a hydraulic fracture in the rock (acid fracturing). A single vertical hydraulic fracture extends in opposite directions away from the wellbore, in the azimuth direction determined by stress in the earth. This may not be the direction preferred to maximize recovery of hydrocarbons from the formation.

Acid in the hydraulic fracture etches the wall of the fracture, which provides a path to allow greater flow rate to the well. But earth stress tends to close the fracture and limit flow capacity of the fracture. Also, fluid flowing towards the wellbore brings insoluble components of the rock that may clog the fracture. Due to the above circumstances, the traditional acid injection procedures affect only a small portion of the reservoir. In addition, with acid fracturing there is the risk that the fracture will extend vertically into an unwanted water zone, which can make production of the well uneconomical.

To improve recovery, industry has resorted to drilling horizontal wells. These have been especially successful in naturally fractured reservoirs, where the horizontal wellbore may intersect natural vertical fractures. Horizontal wellbores may be drilled by using a directional drilling assembly to change the direction at the bottom of a vertical well as the well is drilled, forming a radius of curvature of 25 feet or more. Horizontal wells may also be formed by drilling "drainholes" out of a wellbore with a directional drilling assembly or by diverting flexible tubing and driving or pushing the tubing through the earth. These are usually expensive procedures and have a typical turning radius of twenty-five or more feet.

There is a need for apparatus and methods that are economical and reliable to drill drain holes in carbonate reservoirs so as to recover more of the resources from the formations.

BRIEF SUMMARY OF THE INVENTION

Apparatus and method to drill very short radius drainholes using a micro-jet bit on a very flexible tubular and a chemically reactive drilling fluid are disclosed. A slip joint is provided between the very flexible tubular and a separate tubular. Drain holes, typically about 1-inch or larger in diameter, around a vertical or horizontal borehole are formed. Methods to enable a very small turning radius through a diverting body to produce drain holes away from a wellbore at multiple azimuth angles are provided. Hydrochloric acid may be used as a drilling fluid in reservoirs containing a significant amount of carbonate minerals. Also disclosed are apparatus and method for mixing hydrochloric acid and a base such as sodium hydroxide near the micro-bit to increase the temperature of remaining hydrochloric acid so as to increase the reaction rate with rock being drilled, which is particularly useful when drilling dolomite. An expandable membrane to increase flow resistance in the annulus between the very flexible tubular and the wall of a drainhole to improve the flow capacity of a drain hole drilled with the disclosed apparatus is also disclosed.

BRIEF DESCRIPTION OF THE SEVERAL VIEWS OF THE DRAWING(S)

For a more complete understanding of the present invention and the advantages thereof, reference is now made to the following description, taken in conjunction with the accompanying drawings, in which like reference numbers indicate like features and wherein.

DETAILED DESCRIPTION OF THE INVENTION

Figure 1:
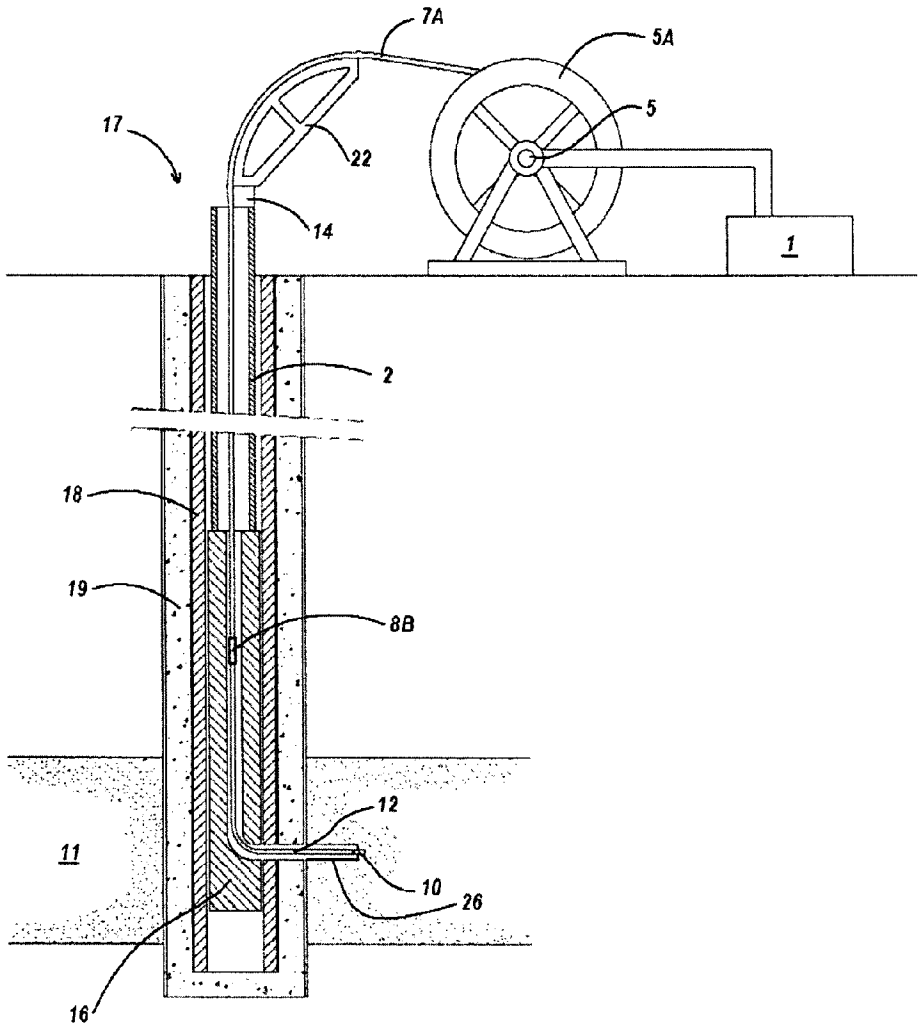
FIG. 1 illustrates apparatus to drill drain holes using a very flexible tubular from coiled tubing.

Referring to FIG. 1, pump 1 pressurizes the drilling fluid to flow through coiled tubing 7A, coming off reel 5 and 5A, which passes over horsehead 22 and down tubing or work string 2 into well 17. Casing 18 has been cemented in well 17 using cement 19. The bottom of coiled tubing 7A is connected to connector 8B, which is also connected to a very flexible tubular (or hose) 12. "Very flexible tubular" as used herein means a flexible tubular or hose that can be deformed into a radius of curvature not greater than 24 inches. Preferably the very flexible tubular can be deformed into a radius of curvature of about 4 inches or less. Larger bend radii may be used in larger-diameter wells. Connector 8B may be a regular screw connection.

Micro-jet bit 10 is attached to the bottom of very flexible hose 12 and is shown drilling lateral drain hole 26 into formation 11. Drilling fluid exits micro-jet bit 10 as a fluid stream as shown at 25 in FIG. 5. The term "micro-jet bit," as used herein, means a bit having a length and diameter less than about 3 inches that directs jets of drilling fluid to drive the bit forward or in the direction of drilling. Preferably a micro-jet bit has a length less than about 1.5 inches and a diameter less than about 1 inch. The term "jet bit" means a bit that directs jets in the direction of drilling. A suitable bit is disclosed in U.S. Pat. No. 6,668,948, which is hereby incorporated by reference in its entirety. At the bottom of the well work string or tubing 2 is diverter 16, which diverts micro-jet bit 10 and very flexible hose 12 to cause the micro-jet bit to go in a more horizontal direction to drill a lateral drain hole 26. A suitable diverter is disclosed in U.S. Pat. Nos. 6,263,984 and 6,668,948, which are hereby incorporated by reference in their entirety. A suitable very flexible hose is EATON AEROQUIP FC465-05.

Figure 2:
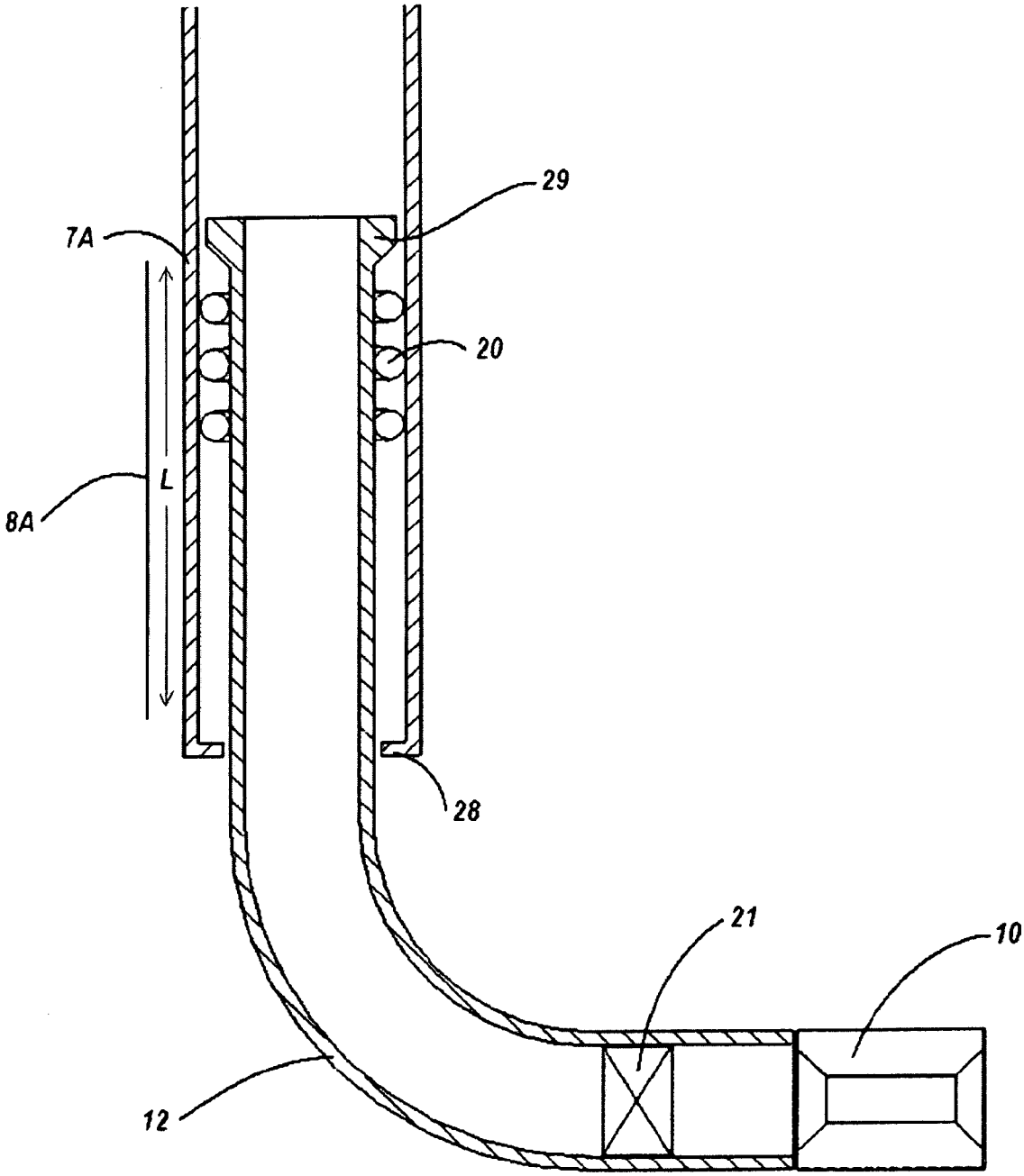
FIG. 2 illustrates a slip joint connector between flexible tubing and the inside diameter of coiled or rigid tubing.

FIG. 2 illustrates an alternative connector between coiled tubing 7A and very flexible hose 12. Bit 10 may be a micro-jet bit or may be a jet bit (without jets directed so as to drive the bit in the direction of drilling). Slip connector 8A provides a slip connection, which allows hose 12 to move from within coiled tubing 7A to below coiled tubing 7A as bit 10 drills. Preferably, very flexible hose 12 has low friction seal 20 on its outside, such as, metal, Teflon or Viton O-rings or similar seals. Alternatively, seal 20 may be provided by O-rings or similar seals inside tubing 7A. Tubing 7A and very flexible hose 12 are sealed such that as pressure is increased in tubing 7A and hose 12, a piston or hydraulic force will push hose 12 out of tubular 7A. If bit 10 is a micro-jet bit it will also produce a force that will pull hose 12 such that it slides relative to the tubing 7A via the seals. Tubing 7A may move until shoulder 28 on tubing 7A and stop area 29 on hose 12 come into contact to cause hose 12 to stop moving relative to tubing 7A. The piston force caused by pressure in tubing 7A will apply a force on hose 7A to assist in pushing the hose from the tubing and applying a force to drive bit 10 forward. Bit 10 in FIG. 2 may be a micro-jet bit or a jet bit. The hydraulic force at the slip joint may apply supply sufficient force at bit 10 that a jet bit may be used. One-way valve 21 may also be used in hose 12 so that fluid will only flow in one direction.

Slip joint 8A may enable hose 12 to slide either inside or outside a large coil tubing (2.5" I.D.) or in small tubing (0.5" I.D. or less). Using slip connector 8A, the length, L, of hose 12 initially present in coiled tubing 7A determines the maximum length that the bit can travel in the formation without moving coiled tubing 7A. An important advantage of the apparatus illustrated in FIG. 2 is that coil tubing 7A is stationary during drilling. This avoids the high rate of fatigue in the metal of coiled tubing when the tubing is pressurized and is bending at the same time, as when it passes over a horsehead or injector while high-pressure fluid is in the tubing.

Load cell 14 (FIG. 1) can be used to monitor the total force down on the tubing. Pump pressure can be monitored to indicate progress of the micro-jet bit 10.

To determine the forward force on the micro-jet bit 10 due to the internal pressure at the bit, where jets exit the bit directed away from the direction of forward movement of the bit, one uses the product of cross-sectional area of a projected plane inside the bit multiplied by the internal pressure in the bit. For example, if the inside cross-sectional area of the jets is 0.785 inch, as for a bit with a radius of ½-inch, and the pressure difference is 1,000 psi, this produces a force forward of 785 lbf. If the initial length of the very flexible hose 12 inside the coil tubing is 1,000 feet ("L" in FIG. 2), the flexible hose can turn through a diverter and travel about 1,000 feet into the reservoir.

Figure 3:
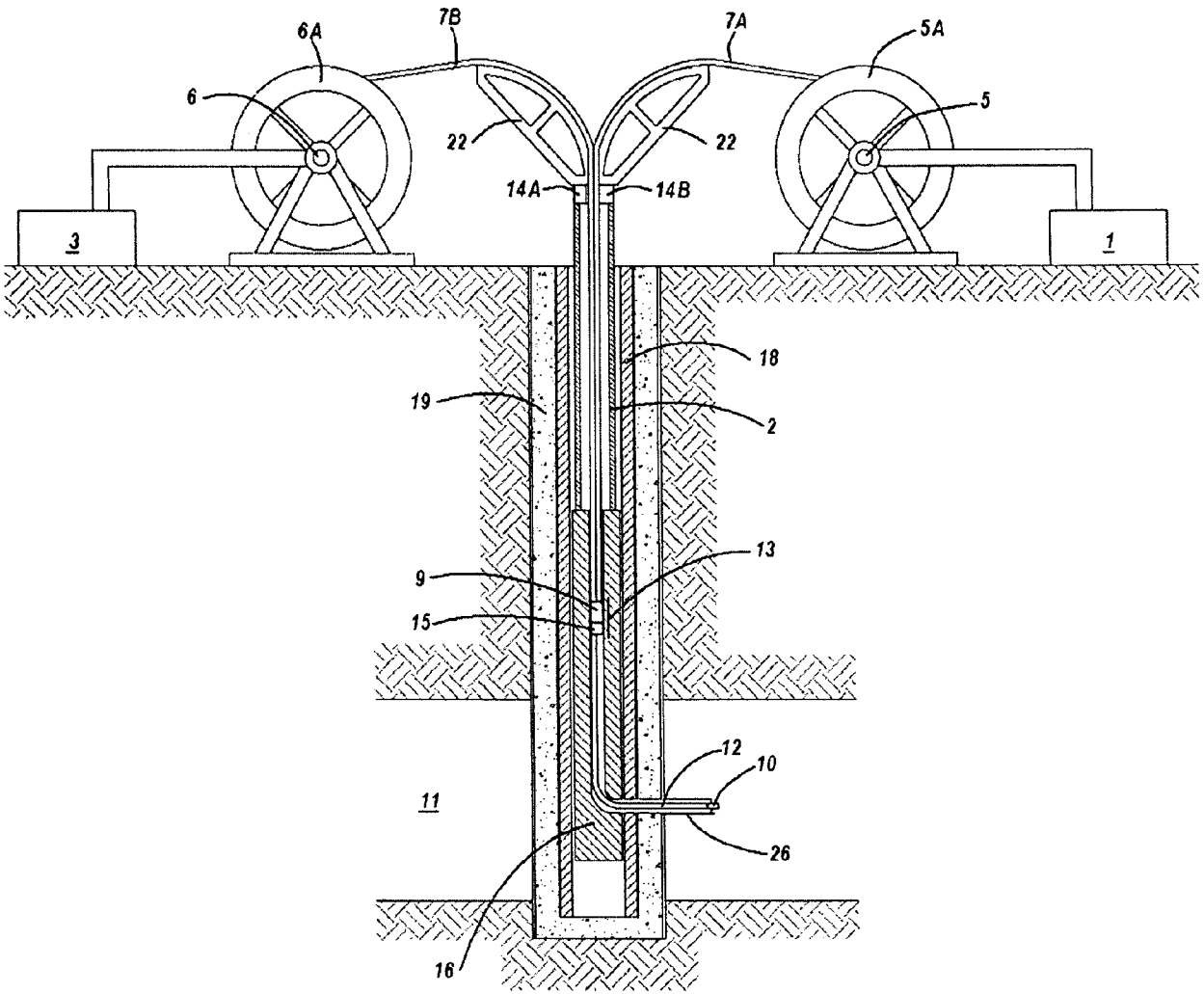
FIG. 3 illustrates apparatus for mixing two fluids downhole before jet drilling using coiled tubing and a very flexible tubular.

FIG. 3 illustrates an apparatus for pumping two liquids downhole through two coiled tubing strings, 7A and 7B. The coiled tubing may be separate, as in the figure, attached side by side as a duplex tubular, or a coil within a coil. Coiled tubing 7B comes off reel 6 and 6A. Apparatus for the two strings is designated by "A" and "B," and is the same as identified and illustrated in FIG. 2. Two pumps, 1 and 3, are provided. The two fluids may flow together at connector 9 and be mixed in mixing chamber 13 or they may mix while flowing through very flexible hose 12. This resultant mixed fluid then passes through bit 10 to subterranean formation 11. Temperature sensor 15, which may be a thermistor, can be located where the fluid has been mixed. Output of the temperature sensor may be recorded downhole or may be transmitted to the surface using methods well known in industry. Load cells 14A and 14B can be used to monitor the total force down on the tubing.

Figure 4:
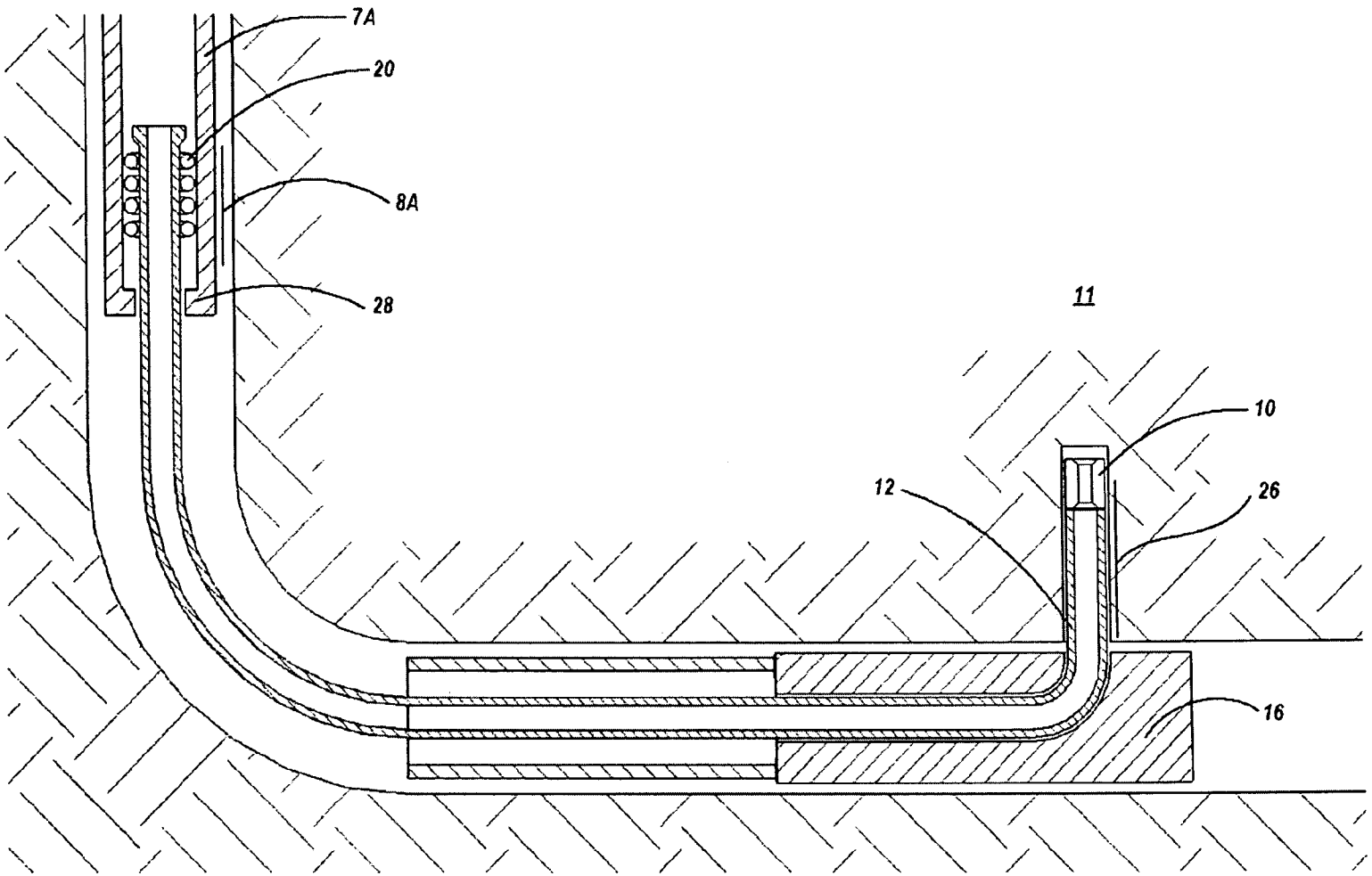
FIG. 4 illustrates apparatus to chemically drill a formation from a horizontal open hole.

FIG. 4 illustrates an arrangement that can be used in a horizontal borehole, either with casing or without, as illustrated. Slip joint 8A may be placed in the vertical segment of a well on coiled tubing 7A. Very flexible hose 12 with short bend radius 12 and micro-jet bit 10 are then diverted to drill into formation 11, using diverter 16. Diverter 16 can be attached to the tubing or work string 2 (not shown). Alternatively, diverter 16 can be attached to a packer set in the bore hole 26. Diverter 16 may be rotated to allow drilling lateral borehole 26 at any angle in a plane perpendicular to the wellbore.

Figure 5:
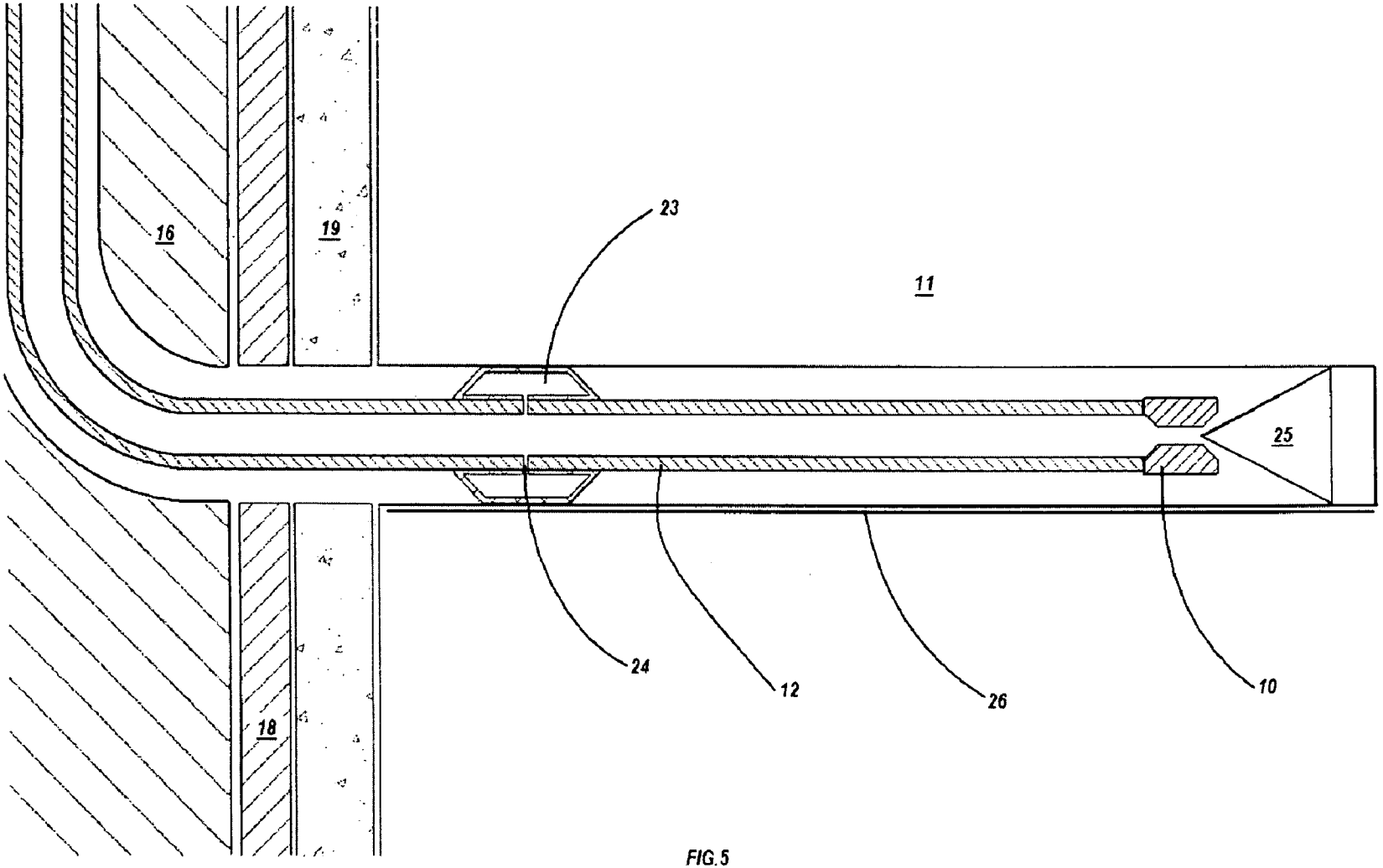
FIG. 5 illustrates a flexible membrane on a very flexible tubular in a lateral borehole drilled through casing.

FIG. 5 illustrates the arrangement for drilling lateral drain hole 26 in which an elastic membrane 23 is connected outside very flexible hose 12 such that fluid may pass through port 24 to inflate the membrane and increase flow resistance in the annulus. Port 24 may be small enough that one can jet drill a lateral and after a period of time the pressure in very flexible tubular 12 will cause membrane 23 to pack-off or partially pack-off lateral bore hole 26. After the membrane expands, pressure builds up in lateral borehole 26 to treat the reservoir surrounding lateral 26 beyond the membrane. Pressure may exceed fracturing pressure in formation 11. After sufficient fluid flows to treat lateral borehole 26, pressure is reduced in tubing 12 to allow the pressure to be reduced in membrane 23, such that tubing 12, membrane 23, and micro-jet bit 10 can be retrieved from lateral borehole 26.

Tubulars 7A, 7B and 12 can be selected to be very resistant to acid (using steel-reinforced rubber or other plastics and epoxies for tubular 12). A preferred drilling fluid for the method and apparatus disclosed herein is a 15% by weight solution of hydrochloric acid, which is a widely available commercial product. Other concentrations may be used, for example 28% acid. The acid is normally used with a corrosion inhibitor (for example, NALCO EC-9519A). The drilling fluid may be pumped through the coiled tubing 7A, through connector 8, through very flexible hose 12 and through micro-jet bit 10, as illustrated in FIG. 1. A plurality of drain holes may be drilled a selected azimuth angles and selected depths. After drilling is complete, the drilling apparatus may be removed from the well and the well placed on production.

A 15% solution of HCl is about 4 moles per liter. Two moles of acid reacts with 1 mole of calcium carbonate. Hence 72.8 grams of HCl reacts with 100 grams of $CaCO_3$. Assuming the orifices of the micro-jet bit 10 are such to enable 10 gallons per minute (37.84 liters/min) of 15% (by weight) of HCl to enter the subterranean formation, and that about 0.48 liters of 15% HCl (one mole) dissolves about 100 grams of $CaCO_3$ (one mole), then each minute the quantity of HCl contacting the formation dissolves 7,883 grams of calcium carbonate. The borehole effective length and diameter can be calculated as below:

$$(2.7\ \text{gms/cm}^3)\times\pi\times(\text{radius})^2(\text{length})=7{,}883\ \text{grams}$$

Assuming the effective radius of the lateral borehole to be 2.5 centimeters, the expected rate of progress just due to dissolution of the calcium carbonate is expected to be 148 centimeters per minute or about five feet per minute. Quite obviously some of the fluid will go into cracks and pores along the lateral so one expects the rate of progress to be less than five feet per minute just for dissolution of low porosity limestone. Hence one expects by pumping at a rate of 10 gallons per minute of 15% HCl that the jet bit 10 will progress at a rate of several feet per minute due to the dissolution method. By using high pressures and erosion drilling techniques, such as disclosed in U.S. Pat. No. 6,668,948, in addition to dissolution of the subterranean formation as disclosed herein, much higher drilling rates and/or lower drilling pressures can be achieved in some formations.

Field experiments were conducted on very tight limestone (porosity about 5%) and the rate of progress of the micro-jet bit using 15% hydrochloric acid was about 1 to 3 feet per minute at a nozzle pressure of 6,000 psi and a flow rate of about 8 gallons per minute. Using no acid in the drilling fluid, the micro-jet bit would not penetrate the formation until the pressure at the micro-jet bit was increased above about 9,000 psi. This higher pressure requires much greater integrity of the tubulars and connections, especially when one is turning in a radius of less than 4 inches, and it increases the probability of failure down hole, which can be quite expensive to repair. This was performed without using a slip joint connector 8A. By using a slip joint connector and acid, a greater forward force on the micro-jet bit 10 is expected to produce a greater penetration rate. By using acid, one can drill in carbonate formations at lower pressures and one does not have the cuttings to contend with as in conventional jet drilling. By drilling with acid, this also reduces or eliminates the possibility of the cuttings plugging the pores in the formation, which reduces the production rate of the well.

By acid jet drilling formations that are predominantly acid-soluble, few cuttings will remain in the borehole and the problem of removal of cuttings will be much less. The composition of an example formation susceptible to acid drilling is shown in Table 1. The results were obtained by analyzing borehole cuttings from a well in Clinton County, Kentucky. Sample A was from a Sunnybrook zone, sample B was from a Stones River zone, Sample C is from a Murphreesboro zone and sample D is from a lower Murphreesboro zone.

TABLE 1

Chemical Composition of Cuttings

| Mineral wt % | A | B | C | D |
|---|---|---|---|---|
| Quartz | 5 | 2 | 3 | 12 |
| Plagioclase | 1 | N.D. | N.D. | 3 |
| Calcite | 61 | 85 | 82 | 72 |
| Fe-dolomite | 27 | 7 | 9 | 4 |
| Pyrite | 1 | 1 | 1 | trace |
| Apatite | N.D | N.D. | N.D. | 1 |
| Mica and Illite | 2 | 3 | 3 | 5 |
| Chlorite | 2 | 1 | 1 | 2 |
| Estimated solubility | 88% | 92% | 91% | 76% |

Estimated solubility consists of adding the calcite and dolomite compositions. All zones are over 75% soluble with most being about 90% soluble. These zones are excellent candidates for acid jet drilling techniques as described herein.

Higher temperature hydrochloric acid may be desirable is some formations. For example, many carbonate formations contain substantial amounts of dolomite ($CaMg(CO_3)$). The reaction rate of dolomite with acid at the same temperature is less. By using the duplex tubing of FIG. 3, tubes 7A and 7B, or coil in coil, may be used to convey solutions of hydrochloric acid in one tube and sodium hydroxide in another tube, mixing them near the slip connector 8A to produce a solution still having an excess of acid. Mixing the acid and base induces a very exothermic reaction, which can increase the temperature of the solution substantially. If this higher temperature HCl fluid is jetted through the micro-jet bit, the immediate surrounding subterranean formation will react faster to the acid. Without this increased temperature in the dolomite formation near the micro-jet, the reaction rate of the acid and the dolomite will be too slow in many cases and will not be practical.

The reaction of hydrochloric acid with sodium hydroxide produces 56.2 kilojoules per mole of reactants. The ratio of the acid concentration to base concentration is selected to achieve an increase in temperature of the remaining acid. For example, if 4 moles of NaOH in 0.25 liters reacts with 8 moles of HCl in one liter, this produces an exothermic energy of about 224,800 joules in a total solution of 1.25 liters. This is sufficient to raise the temperature of the resulting 1.25 liters of solution containing 4 moles of HCl by about 97 degrees Fahrenheit. This will increase the reaction rate of the remaining HCl in solution to react with the immediate surface of the rock formation to improve the dissolution of both the limestone and dolomite rocks. Alternatively, the concentration of base may be increased and the rate of pumping of the base stream may be correspondingly decreased.

A common fluid used to treat sandstone is to use hydrochloric acid and hydrofluoric acid, such as 12% HCl and 3% HF. The hydrochloric acid reacts with the carbonate cement of the sand particles. The HF reacts similarly with the carbonates; however, it also has the ability to react with silicates, which include clay, silt, shale, sands, and other solids typically used in drilling muds. For this reason, HF is the most widely used acid system for stimulating sandstone reservoirs. The duplex system illustrated in FIG. 3 can be used to add HCl in one tubular and HF in another and also HCl or HF in one tubular and NaOH in another tubular. The latter mixing may be used to increase temperature of the fluid entering the formation. This will result in better treatment of the localized subterranean formation around the drain hole. By forming drain holes in the reservoir using the methods and apparatus and methods disclosed herein, hydrocarbon recovery from the sandstone will be increased.

Although the present invention has been described with respect to specific details, it is not intended that such details should be regarded as limitations on the scope of the invention, except to the extent that they are included in the accompanying claims.

I claim:

1. A method for drilling a drain hole from a well in a subterranean formation containing a carbonate mineral, comprising:

providing two pumps, a drilling fluid containing an acid and a second solution;

placing a work string in the well, the work string having attached thereto a diverter;

placing a first and a second tubular in the well within the work string, the tubulars having distal ends and a connector attached to the distal ends, the connector having attached thereto a very flexible tubular, the very flexible tubular having a proximate end attached to the connector and a distal end attached to a jet bit or a micro-jet bit;

pumping the drilling fluid through the first tubular and the second solution through the second tubular through the very flexible tubular and out the bit, and dissolving the carbonate material by directing the drilling fluid containing an acid toward the formation thereby forming a drain hole.

2. The method of claim 1 wherein the second solution is a solution containing a base at a selected concentration.

3. The method of claim 1 wherein the second solution is a solution containing hydrofluoric acid.

4. The method of claim 1 further comprising providing a mixer between the distal ends of the first and second tubulars and the very flexible tubular.

5. The method of claim 1 wherein the first and second tubulars are attached to form a duplex tubular or concentric tubular.

6. The method of claim 1 wherein the very flexible tubular further includes an elastic membrane outside and at a selected distance from the distal end, the elastic membrane enclosing a port in the very flexible tubular such that fluid may pass through the port to inflate the membrane and increase the flow resistance in an annulus between the very flexible tubular and the drain hole.

7. The method of claim 1 wherein a temperature sensor is supplied between the tubulars and the bit.

* * * * *